US006725791B2

(12) United States Patent
Mukai

(10) Patent No.: US 6,725,791 B2
(45) Date of Patent: Apr. 27, 2004

(54) FABRIC GUIDE DEVICE FOR A SEWING MACHINE

(75) Inventor: Hirochika Mukai, Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/424,237

(22) Filed: Apr. 28, 2003

(65) Prior Publication Data

US 2003/0209177 A1 Nov. 13, 2003

(30) Foreign Application Priority Data

May 13, 2002 (JP) ..... 2002-136769

(51) Int. Cl.[7] ..... D05B 35/10; D05B 1/02
(52) U.S. Cl. ..... 112/153; 112/147; 112/162
(58) Field of Search ..... 112/153, 147, 112/141, 136, 260, 306, 314, 162, 148, 150

(56) References Cited

U.S. PATENT DOCUMENTS 1,301,808 A * 4/1919 Brackett ..... 112/147
1,523,760 A * 1/1925 Dowdall ..... 112/15
4,467,739 A * 8/1984 Hager et al. ..... 112/153
5,313,898 A 5/1994 Ishibashi
6,112,683 A * 9/2000 Francesco ..... 112/147
6,481,362 B2 * 11/2002 Hietpas et al. ..... 112/475.06
6,634,308 B1 * 10/2003 Martin ..... 112/235

FOREIGN PATENT DOCUMENTS

JP 05-076678 3/1993

* cited by examiner

*Primary Examiner*—Ismael Izaguirre
(74) *Attorney, Agent, or Firm*—Flynn, Thiel, Boutell & Tanis, P.C.

(57) ABSTRACT

A fabric guide device for a sewing machine has an upper plate and a middle plate, and is disposed at the fabric feed side of the presser foot of the sewing machine. The upper plate is disposed on the sewing machine bed in a state of keeping a certain clearance from the sewing machine bed, and its fabric feed side portion is warped upward. The middle plate is disposed beneath said warped portion of the upper plate, and is free to project and retreat from and into the sewing machine bed. The middle plate has upper and lower surfaces for guiding the upper and lower bodies. When sewing said bodies together, first the middle plate projects from the sewing machine bed to insert between the bodies. Then the bodies are pulled forward, and the over-edge chain stitching portions are engaged with the middle plate to be tilted to the fabric feed side. In the tilted state, the bodies are further pulled to the front side, and the over-edge chain stitching portions are positioned beneath the presser foot, and then the presser foot is lowered to start sewing operation.

2 Claims, 4 Drawing Sheets

FABRIC GUIDE DEVICE FOR A SEWING MACHINE

The present invention relates to a fabric guide device for a sewing machine, and more particularly to a fabric guide device for a sewing machine used at overlaying over-edge chain stitching portions individually formed in upper and lower bodies face to face, and sewing together the overlapped portions.

BACKGROUND OF THE INVENTION

A sewing process includes a specification of opening a body obtained by executing over-edge chain stitching to two fabrics, folding its over-edge chain stitching portion face to face, and sewing together the folded portion. In such specification, as shown in FIG. 4, when the over-edge chain stitching portions (Wc, Wc) in raised state come beneath the presser foot, the over-edge chain stitching portions (Wc, Wc) are usually tilted backward. At this time, these portions are overlapped or squeezed, and a large step is formed to lower the product quality.

Japanese Laid-open Patent No. H05-76678 discloses a fabric guide device designed to prevent from forming bulkiness in the over-edge chain stitching portions in upper and lower bodies by using a pair of tilting pawls. This device is disposed on a sewing machine table before the sewing machine bed, and the pair of tilting pawls are designed to guide to tilt down the over-edge chain stitching portions in the upper and lower bodies. This device can be applied to the bodies in which the over-edge chain stitching portions project outward, but cannot be applied to the bodies in which the over-edge chain stitching portions face each other between the bodies, and moreover since the fabric guide device is disposed on the sewing machine table before the sewing machine bed, a space for the sewing machine table is needed before the sewing machine bed.

It is hence an object of the invention to present a fabric guide device for a sewing machine capable of operating to tilt in one direction prior to sewing operation of over-edge chain stitching portions mutually projecting between bodies, and downsizing or omitting the sewing machine table before the sewing machine bed.

SUMMARY OF THE INVENTION

The fabric guide device for a sewing machine according to the present invention is used at sewing overlaid portion together by overlaying over-edge chain stitching portion face to face after opening a body obtained by executing over-edge chain stitching to two fabrics, and it is disposed at the fabric feed side from the presser foot of the sewing machine. This fabric guide device is composed of upper plate and middle plate. The upper plate is disposed on the sewing machine bed in a state of keeping a certain clearance from the sewing machine bed, and its fabric feed side portion is warped upward. The middle plate is disposed beneath the warped portion of the upward warp of the upper plate, and is free to project and retreat from and into the sewing machine bed. The middle plate has upper and lower surfaces for guiding the fabrics.

At the time of sewing, the body is overlaid so that its over-edge chain stitching portion may face each other prior to sewing, and is fed into the fabric guide device while handling under the presser foot. Consequently, the middle plate projects from the sewing machine bed to interpose between upper and lower bodies before the over-edge chain stitching portions, and when said bodies are pulled out to the front side in this state, the over-edge chain stitching portions abut against the middle plate and tilt in the fabric feed direction. In this state, the fabrics are further pulled out, and the tilted over-edge chain stitching portions are positioned beneath the presser foot. At this time, since the bodies pulling direction is opposite to the tilting direction of the over-edge chain stitching portions, and the tilted over-edge chain stitching portions are not raised when the bodies are pulled, and remain in tilted state at the time of pulling. The presser foot is lowered while the over-edge chain stitching portions are positioned beneath the presser foot, and the fabrics are seamed.

According to the present invention, the over-edge chain stitching portions projecting face to face between upper and lower bodies can be tilted in the fabric feed direction by simple operation of fabric manipulation and middle plate manipulation, and the job burden of the operator is less and the productivity is enhanced.

Besides, since the fabric guide device of the present invention is disposed in the sewing machine bed, sewing machine table for disposing the fabric guide device is not needed before the sewing machine bed, and if a sewing machine table is provided, since the fabric guide device is not mounted on it, the size of the sewing machine table can be reduced.

The middle plate of the present invention is preferred to have a perpendicular surface at the fabric feed side. By pulling the fabrics to the front side while the over-edge chain stitching portions are in contact with the perpendicular surface of the middle plate, the over-edge chain stitching portions are tilted more securely.

Other features and effects of the present invention will be more clearly understood in the following detailed description of the embodiments by those skilled in the art. It must be, however, noted that the technical scope of the present invention is not limited to the embodiments and the accompanying drawings alone.

DESCRIPTION OF THE PREFERRED EMBODIMENT

Figure 1:
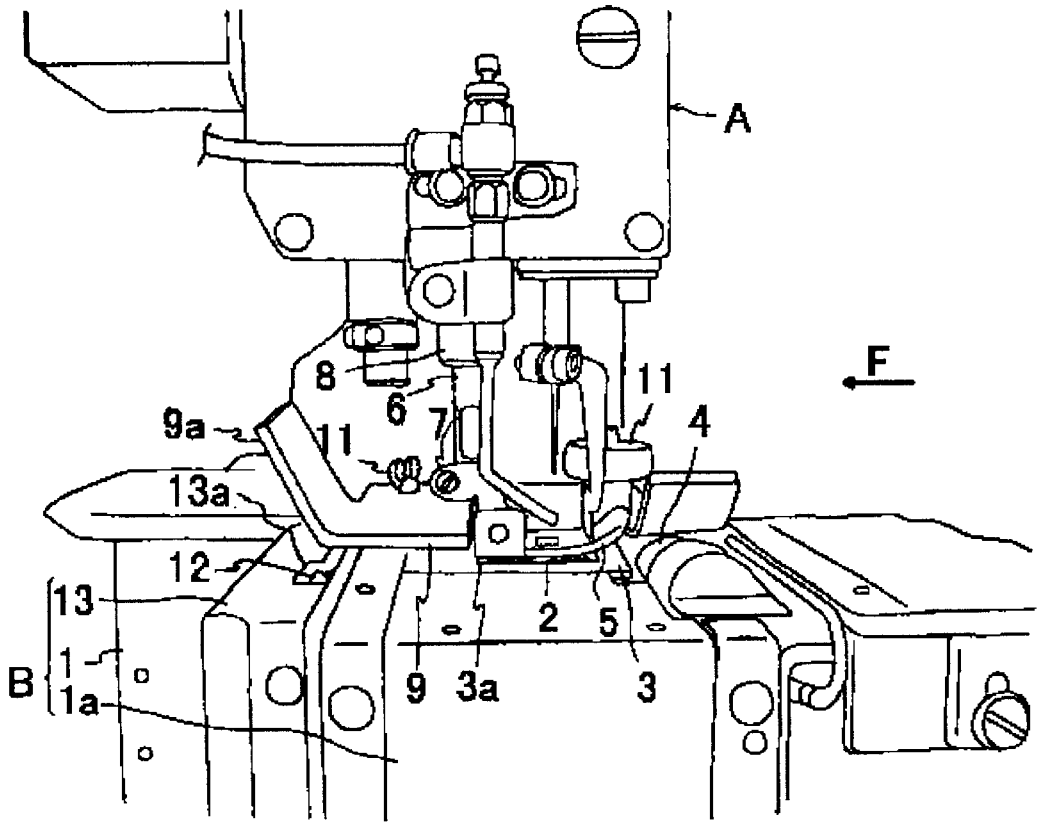
FIG. 1 is a schematic side view of a sewing machine having a fabric guide device according to the present invention.

FIG. 1 is a schematic side view of a sewing machine having a fabric guide device according to the present invention. A sewing machine bed B comprises a bed main body 1, a cylinder bed 1*a* extending sideways from the bed main body 1, and a chassis 13 provided at the cylinder bed 1*a*. The cylinder bed 1*a* is provided with a feed dog 2. The feed dog 2 moves in and out from a feed groove 3*a* of a throat plate 3, and moves back and forth in the feed groove 3*a*. A fabric is fed in the direction of arrow F by the food dog 2.

In front of the feed dog 2, a movable cutter 4 is disposed. When the movable cutter 4 cooperates with a receiving cutter (not shown) fixed in the cylinder bed 1*a* while moving up and down, a edge of the folded lower side fabric Wa are cut neatly along the fabric feed direction F.

A presser foot 5 is disposed on the throat plate 3. The presser foot 5 is fixed to the lower end of a presser bar 6 by a screw 7, and the presser bar 6 is slidably supported vertically on a bushing 8 provided in a sewing machine arm A. The presser bar 6 is pushed down by the action of compression coil spring not shown, so that the presser foot 5 presses the fabric against the throat plate 3 of the sewing machine bed B.

Figure 2:
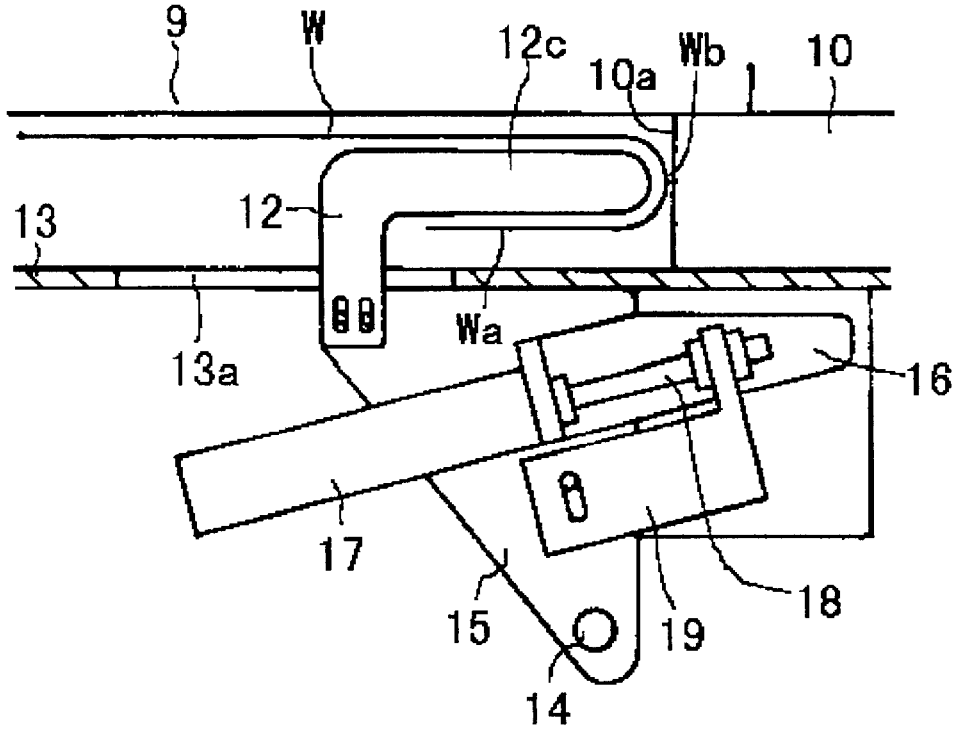
FIG. 2 is a rear view of essential parts showing a state of use with a middle plate projecting from a hole in a chassis.
Figure 3:
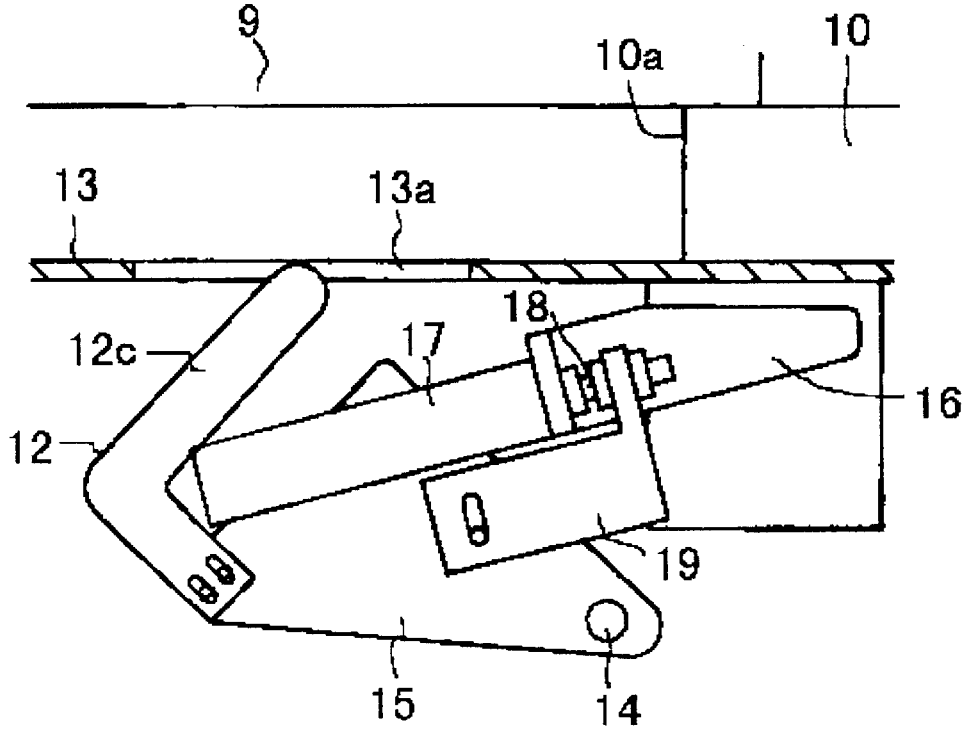
FIG. 3 is a rear view of essential parts showing a state of storing the middle plate in the chassis.

An upper plate 9 is disposed at the fabric feed side of the presser foot 5. As shown in FIG. 2 and FIG. 3, the upper plate 9 is fixed to the cylinder bed 1*a* by a nut 11 through a washer 10 having a certain thickness. By the thickness of the washer 10, a certain clearance is provided between the cylinder bed 1*a* and the upper plate 9. The fabric feed side portion 9*a* of the upper plate 9 is a warped portion of upward warp.

Between a warped portion 9*a* of the fabric feed side of the upper plate 9 and a chassis 13, as shown in FIG. 5 through FIG. 8, there is a middle plate 12 having a triangular section and extending in a direction orthogonal to the arrow F direction. The middle plate 12 has an inclined upper surface 12*c*, a horizontal lower surface 12*d*, and a perpendicular surface 12*b*. The inclined upper surface 12*c* guides an upper body (a main body) W, and the horizontal lower surface 12*d* guides a lower body Wa folded from the main body W. The perpendicular surface 12*b* is positioned at the fabric feed side.

The middle plate 12 is further fitted to a triangular plate 15 adjustable in position through a slot as shown in FIGS. 2 and 3, and the plate 15 is rotatably supported by a pin 14 fixed to the chassis 13. The plate 15 is further coupling to a coupling plate 19 fixed to a piston rod 18 of a pneumatic cylinder 17, and the pneumatic cylinder 17 is attached to a bracket 16 fixed to the chassis 13. By forward and backward motion of the piston rod 18, the middle plate 12 is moved in and out from a hole 13*a* of the chassis 13, as shown in FIG. 2 and FIG. 3, while swiveling about a pin 14.

Referring now to FIG. 4 through FIG. 8, the action of the fabric guide device in the sewing operation is explained.

Figure 4:
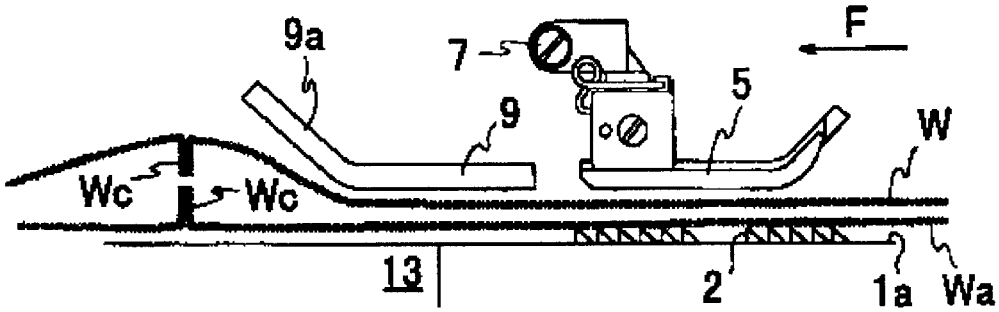
FIG. 4 is a side view showing a state of feeding over-edge chain stitching portions until projecting from an upper plate.

First, the presser foot 5 is raised by stepping on a foot pedal (not shown) or the like, and is separated from the cylinder bed 1*a*. Next, the body W forming over-edge chain stitching portions is opened so as to unfold right and left at the over-edge chain stitching portion Wc. Further, while folding its edge portions downward in a direction orthogonal to the over-edge chain stitching portion Wc so that the over-edge chain stitching portion Wc may face each other, the bodies W, Wa are supplied separately between the presser foot 5 and cylinder bed 1*a*. As shown in FIG. 2, while guiding the folded end portion Wb by the guide surface 10*a* of the washer 10, the bodies are sent in until the mutually facing over-edge chain stitching portions Wc may come out to the fabric feed side from the upper plate 9 (FIG. 4).

Figure 5:
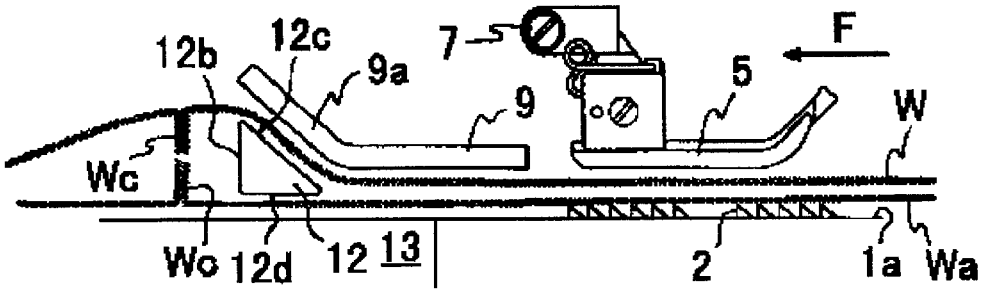
FIG. 5 is a side view showing a state of setting the middle plate.
Figure 6:
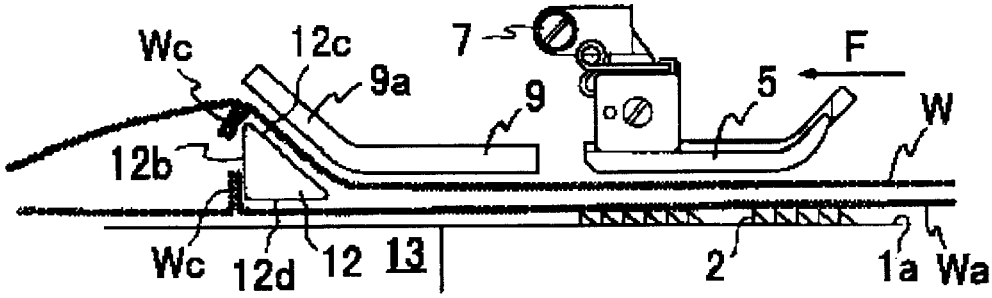
FIG. 6 is a side view showing a state of engagement of over-edge chain stitching portions with the middle plate.
Figure 7:
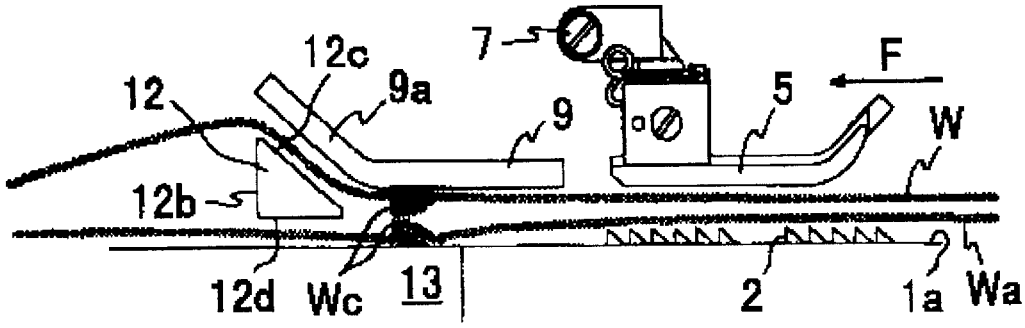
FIG. 7 is a side view showing a state of over-edge chain stitching portions approaching between the upper plate and the chassis.
Figure 8:
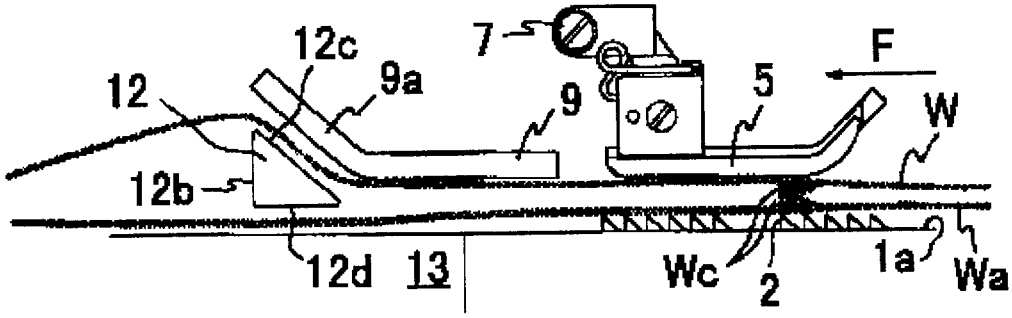
FIG. 8 is a side view showing a state of over-edge chain stitching portions pulled beneath a presser foot.

By the manipulation of knee switch, foot pedal or the like, the piston rod 18 of the pneumatic cylinder 17 projects, and the plate 15 is rotated clockwise from the state in FIG. 3. As a result, the middle plate 12 projects from the hole 13*a* of the chassis 13 so that its leading end is forwarded until the folded end portion Wb. When reaching the folded end portion Wb, the middle plate 12 is extended in a direction orthogonal to the fabric feed direction F as shown in FIG. 2 and FIG. 5 through FIG. 8, and is set between the upper surface of the chassis 13 and the warped portion 9*a* of upward warp of the upper plate 19. At this time, the main body W is positioned on the inclined upper surface 12*c* of the middle plate 12, and the lower body Wa folded downward from the main body W is positioned beneath the lower surface 12*d* of the middle plate 12 (FIG. 5). In this state, when the bodies W, Wa are pulled to the front side, the mutually facing over-edge chain stitching portions Wc are engaged with the perpendicular surface 12*b* of the middle plate 12 (FIG. 6). When further pulling the bodies, the over-edge chain stitching portions Wc are tilted along by the fabric feed direction F, and supported between the chassis 13 and upper plate 9 (FIG. 7). In succession, when the bodies W, Wa are pulled to the front side until the over-edge chain stitching portions Wc reach beneath the presser foot 5 (FIG. 8), the presser foot 5 is lowered onto the throat plate 3 of the cylinder bed 1*a*, and the sewing operation by the sewing machine is started. Right after start, folded portions of the upper and lower bodies W, Wa are seamed, and thus the over-edge chain stitching portions Wc are tilted in the fabric feed direction F, and the upper and lower bodies W, Wa are seamed in this state.

In this example, the upper plate 9 is warped upward only at the fabric feed side, but when the fabric insert side is also warped upward, the body can be inserted smoothly without being blocked by the upper plate 9.

Also in this example, the bodies obtained by executing over-edge chain stitching to two fabrics is opened, its side edges are overlaid by folding so that the over-edge chain stitching portions may face each other. But the present invention may be similarly applied in a case of overlaying two bodies so that the edge portions of the over-edge chain stitching portions may face each other.

What is claimed is:

1. A fabric guide device for a sewing machine used at sewing overlaid portion together by overlaying over-edge chain stitching portion face to face after opening a body (W) obtained by executing over-edge chain stitching to two fabrics, comprising an upper plate (9) disposed on the sewing machine bed (B) at the fabric feed side from a presser foot (5) in a state of keeping a certain clearance from the sewing machine bed (B), said upper plate (9) having a warped portion (9*a*) of the upward warp at fabric feed side portion thereof, and a middle plate (12) disposed beneath said warped portion (9*a*) for guiding an upper body (W) by the upper surface and a lower body (Wa) by a lower surface, said middle plate (12) being free to project and retreat from and into the sewing machine bed (B), wherein upper and lower bodies (W, Wa) having mutually projecting over-edge chain stitching portions (Wc, Wc) are disposed above and beneath the middle plate (12), and said bodies (W, Wa) are pulled in the state of the over-edge chain stitching portions (Wc, Wc) positioned at the fabric feed side from the middle plate (12), so that the over-edge chain stitching portions (Wc, Wc) are tilted to the fabric feed side at the middle plate (12).

2. A fabric guide device for a sewing machine as claimed in claim 1, wherein the middle plate (12) has a perpendicular surface (12*b*) at the fabric feed side.

* * * * *